United States Patent [19]

Knight

[11] 4,350,332

[45] Sep. 21, 1982

[54] SHEET HANDLING APPARATUS

[75] Inventor: Clifford Knight, Newnham-on-Severn, England

[73] Assignee: Xerox Corporation, Stamford, Conn.

[21] Appl. No.: 780,946

[22] Filed: Mar. 24, 1977

[30] Foreign Application Priority Data

Jun. 25, 1976 [GB] United Kingdom ..... 26585/76

[51] Int. Cl.[3] ..... B65H 29/20; B65H 29/70

[52] U.S. Cl. ..... 271/188; 271/233; 271/275; 271/314

[58] Field of Search ..... 271/275, 80, 69, 188, 271/233, 4, DIG. 9, 184, 272, 273, 3, 6, 7, 10, 245, 246, 208, DIG. 3, DIG. 2, 314; 355/75, 76

[56] References Cited

U.S. PATENT DOCUMENTS

| | | | |
|---|---|---|---|
| 3,229,608 | 1/1966 | Staub et al. | 271/272 X |
| 3,565,420 | 2/1971 | Howard | 271/4 |
| 3,620,528 | 11/1971 | Skocir | 271/272 |
| 3,620,615 | 11/1971 | Volkers | 271/DIG. 2 |
| 4,043,550 | 8/1977 | Phillips et al. | 271/233 |

*Primary Examiner*—Bruce H. Stoner, Jr.
*Attorney, Agent, or Firm*—Bernard A. Chiama

[57] ABSTRACT

A flexible sheet handling apparatus having particular application to the handling of documents in a copy machine is disclosed. The sheet handling apparatus includes a curved drive surface, a drive for driving the surface, and a curved reaction surface which defines a curved sheet path extending along the drive surface, the reaction surface being out of contact with the drive surface.

2 Claims, 6 Drawing Figures

SHEET HANDLING APPARATUS

BACKGROUND OF THE INVENTION

I. Field of the Invention

This invention relates to a flexible sheet handling apparatus and has particular application to the handling of documents in a copying machine.

II. Description of the Prior Art

It is conventional to drive a sheet by passing it between a pair of rollers at least one of which is driven, the other usually being an idler roller which acts as a reaction member to maintain a coupling force between the driving roller and the sheet. Particularly when driving thin sheets, such as paper sheets, it is usual for the rollers to run against one another in the absence of a document. Sometimes it is necessary or desirable for the reaction member to be stationary in which case considerable wear may occur at the interface between the roller and the reaction member.

SUMMARY OF THE INVENTION

It is an object of the invention to alleviate or remove this problem. To this end, the invention consists in, from one aspect, a sheet handling apparatus including a curved drive surface, means for driving the surface, curved reaction means defining a curved sheet path extending along the drive surface, the reaction means being out of contact with the drive surface. By such an arrangement, a coupling force is maintained by virtue of the beam strength of the sheet which is curved in its direction of movement by the reaction means and held in contact with the drive surface.

From another aspect, the invention consists in a sheet drive including a curved drive surface, means for driving the surface, stationary reaction means for guiding a sheet against the drive surface, said reaction means being spaced from the drive surface and arranged such that a coupling force is maintained between the sheet and the drive surface.

The drive surface is suitably the peripheral surface of a roller but it could for example be the surface of a belt passing over a roller.

In a preferred form, the apparatus comprises a drive roller, means for rotating the roller, a pair of stationary curved guide surfaces for urging a sheet in a curved path against the periphery of the roller, the guide surfaces being spaced from the roller at opposite sides respectively thereof and arranged radially inwardly of the roller periphery. The guide surfaces are suitably formed by curved fins.

In one application of the invention, the drive is provided at the outlet end of an exposure platen of a copier and the fins are mounted on a corona discharge device extending across the end of the platen. Suitably the discharge device is a pin-type of device having a housing formed as a plastics moulding, the fins being integral with the moulding.

BRIEF DESCRIPTION OF THE DRAWINGS

In order that the invention may be more readily understood, reference will now be made to the accompanying drawings, in which.

DESCRIPTION OF THE PREFERRED EMBODIMENTS

Figure 1:
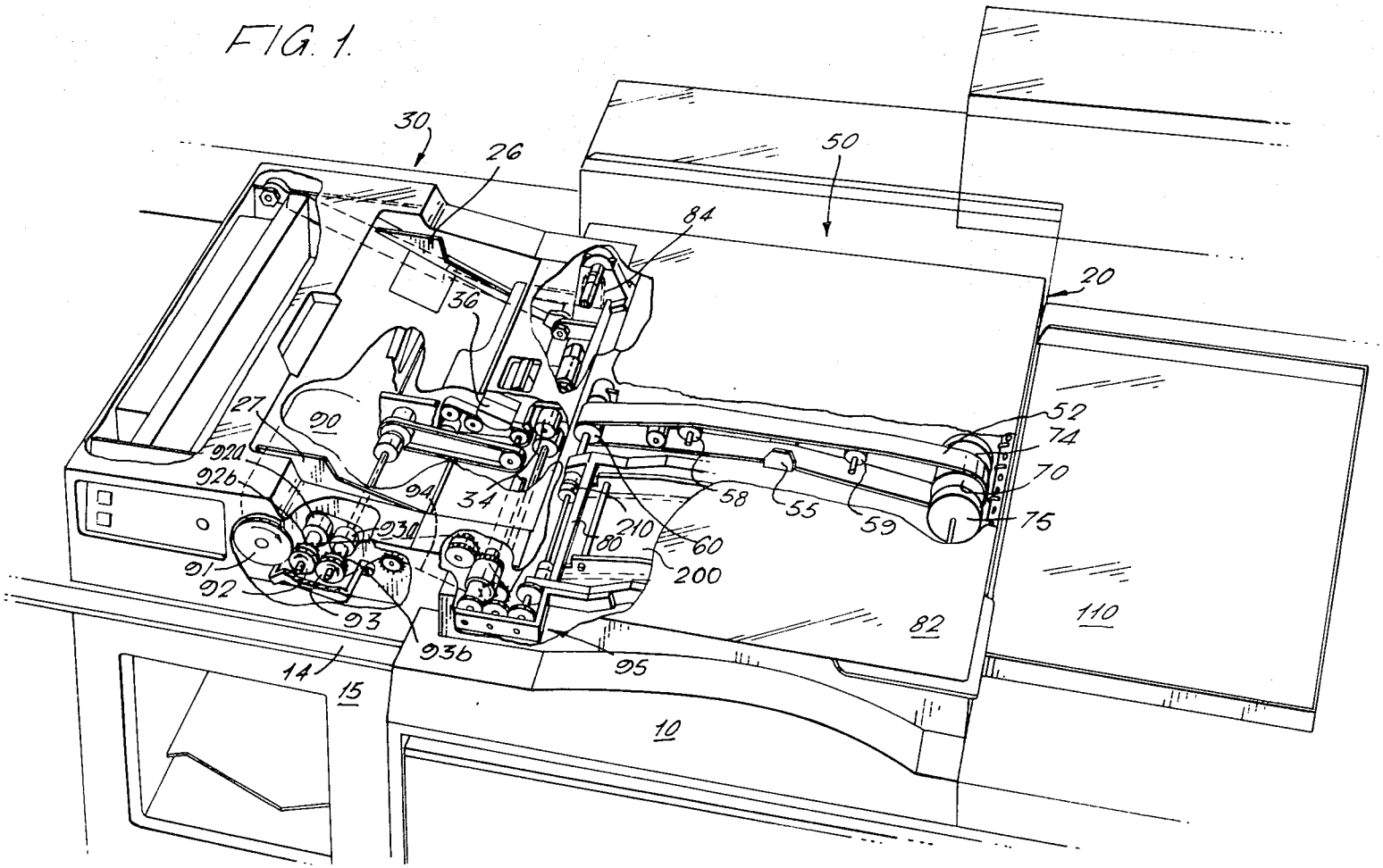
FIG. 1 is a perspective view of a document handling apparatus in accordance with this invention in position on the platen of an electrostatographic copier with parts of the apparatus broken away to show greater detail.
Figure 2:
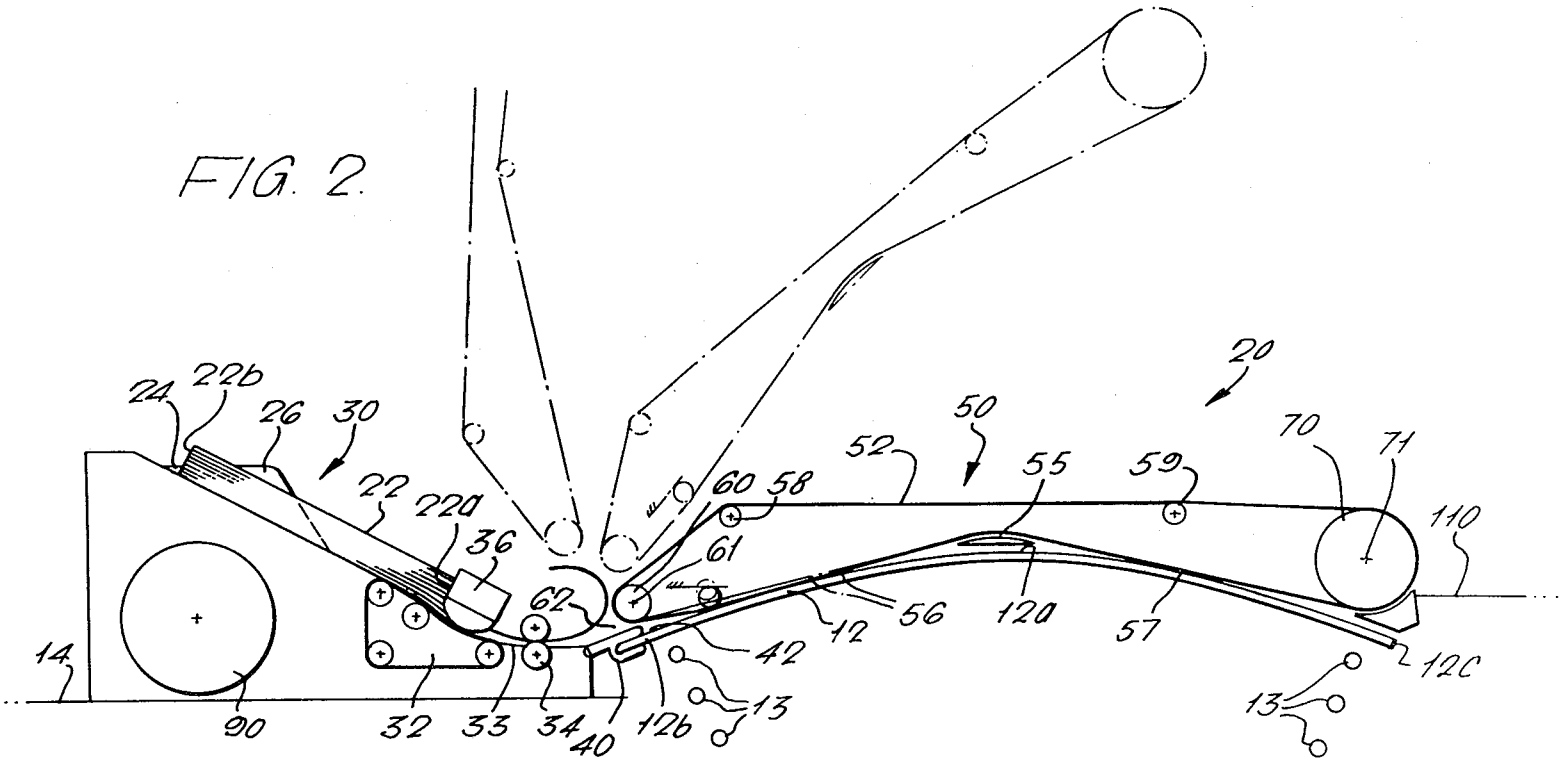
FIG. 2 is a schematic cross-section of the apparatus of FIG. 1.

Referring to FIGS. 1 and 2 of the drawings there is shown a portion of an automatic electrostatic reproduction machine 10 of the kind disclosed for example in U.S. Pat. No. 3,301,126 including a document handling apparatus 20 in accordance with the invention. The document handler 20 overlies a work station comprising an exposure area or platen 12 of the machine 10 and extends over an upper surface 14 of a document output or sorter extension 15 of the machine. The document handler 20 is synchronized with the control of the machine 10 automatically to feed seriatim documents to be copied to the platen 12, register each document and hold it in position on the platen until a selected number of copies has been produced by the machine 10 and then remove it from the platen while feeding the next document to be copied. One method of producing the copies by the machine 10 will be understood for example by reference to the above mentioned U.S. Pat. No. 3,301,126 from which it will be seen that the platen 12 is illuminated from below as suggested by the lamps 13 in FIG. 2 and the image on an upper surface 12*a* of the platen reflected on to a photoconductive surface (not shown) where the image is developed and from which it is transferred to a suitable substrate to produce the copy.

Document handler 20 generally comprises a sheet material feeder 30 and a document transport 50. The feeder 30 includes a supply tray 24 for cut-sheet documents, and a sheet separator mechanism 32 and a pair of advancing or pinch rolls 34 by which the documents are fed one at a time from a stack of documents in the tray 24 to the document transport 50.

For specific details of an embodiment of a sheet separator 32 which has been found to perform particularly well in this environment reference may be made to copending U.S. Application Ser. No. 687,058, filed on May 17, 1976, now abandoned, and assigned to the same assignee as the present application.

In operation, documents 22 which may be ordinary cut sheets of paper having generally parallel and straight forward and rear edges 22*a*, 22*b* respectively, are placed face down for copying in the inclined tray 24 so that the forward edge 22*a* of the documents will be held normal to the direction of document travel by a suitable restraining member 36.

The alignment of documents by the document feeder 30 relative to the exposure station 12 is preferably such that the center line of the documents remains at generally the same position regardless of the width of the document. This alignment is provided in this embodiment by a pair of self-centering side guides 26 and 27 on opposite sides of the supply tray 24 which restrain the side edges of the documents generally parallel to the direction of feed and feed documents from a central area of the stack or pile regardless of the width of the stack.

With the documents in place and the processor 10 set to make the required number of copies of each document 22, automatic operation is initiated by activation of the "start-print" control of the processor 10.

From its position on the bottom of the document pile in tray 24 the first document is separated from the remainder of the stack by the separator 32 and fed forward over a guide 33 so that its forward edge 22*a* enters the nip of the driven pinch rolls 34 which latter pull the document 22 completely from the tray and move its forward edge 22*a* over a registration member 40 and under the control of the transport 50.

The document transport 50 comprises an endless belt 52 riding over and extending between rollers 60 and 70. The belt 52 is driven via the roller 60 which may be rotated in two directions. Anti-clockwise rotation of roller 60 drives the belt "forwards" to advance a document across the platen 12. Clockwise rotation "reverses" the belt for registering the rear edge of a document against the registration member 40. The rollers 60 and 70 rotate on shafts 61 and 71 respectively which are mounted on a movable frame 80 located centrally along opposite sides 12*b* and 12*c* of the platen upper surface 12*a* so that the belt entrained thereover extends across the central portion of the platen or processing station 12. The belt itself is narrow relative to the platen as proposed in copending U.S. Application Ser. No. 687,062, filed May 17, 1976, now U.S. Pat. No. 4,076,233 and assigned to the same assignee as the present application. The frame 80 supports a suitable outer cover 82 which hides the moving parts and prevents light from entering the platen 12.

Advantageously the roller 60 is of small diameter (e.g., 1.5 inches) so that a nip 62 between the belt 52 entrained thereover and the platen surface 12*a* may be as close as necessary to the edge 12*b* of the platen and to the paper feeder 30. The belt 52 rests on the platen surface 12*a* and is made of a material such as silicon rubber on a flexible backing and is preferably white on its outer surface and has a high coefficient of friction with paper type materials, e.g., 0.9. The platen surface 12*a* will usually be smooth glass so that its coefficient of friction with the paper or belt is relatively low e.g., less than 0.4. Consequently, a document in the form of a material with a relatively high coefficient of friction such as paper for example, will be effectively gripped by the belt 52 on its upper side when it is fed into the nip 62 and caused to slide over the surface 12*a* on its lower side under the control of the belt 52.

A schematic illustration of how the transport 50 moves out of position to allow access to the platen area 12 for manual use or cleaning is set forth by the dotted lines in FIG. 2 which show the mechanism in a generally half open position and also in a fully open position. As may be understood from FIG. 1 the frame means 80 pivots about an axis 84 that is spaced above the platen 12 to allow full opening extending the frame 80 upwardly about ninety degrees.

A hitch 55 from the belt 52 is positioned on the outside of the belt 52 to support the belt above the platen 12 at an intermediate point between the rollers 60, 70 so that the belt contacts the platen surface 12 at two separated contact areas 56, 57 spaced along its length, i.e., in the direction of travel of the belt. Preferably, as shown, the intermediate point is generally halfway between the rollers.

Idler rollers such as shown at 58, 59 may be provided as required at other positions along the length of the belt means 52. These may be positioned to adjust belt tension.

Registration member 40 functions to align documents in a predetermined relationship and extends along platen edge 12*b*. Member 40 is arranged so that documents being fed toward the platen 12 in a first direction pass smoothly thereover; however, it includes an edge 42 raised above the surface 12*a* so that once a document has passed thereover and is moved in reverse direction, a trailing edge 22*b* of the document held against the surface 12*a* will abut thereagainst. Registration member 40 is preferably in the form of a generally channel-shaped plastics clip which fits over the edge of the platen glass 12 as described more fully in copending Application Ser. No. 780,890, filed concurrently herewith, now U.S. Pat. No. 4,124,205, entitled "Document Handling", and assigned to the same assignee as this application. A baffle member 200 may be provided, as set out in copending Application Ser. No. 687,059, filed May 17, 1976, now U.S. Pat. No. 4,043,550, and assigned to the same assignee as the present application, to assure proper abutment of the document edge against the registration surface 42. As is known from U.K. Pat. No. 1,122,626 suitable indicia may be provided on the registration member to allow manual alignment of documents when the machine is being used in a manual mode.

By using a narrow belt 52 with crowned rollers 60, 70 construction is greatly simplified in that no side guides are required and tracking problems are greatly reduced compared with a wide belt. I have found that a narrow belt of greater than a 35-1 length to width ratio tracks very well without any guides and does not tend to cause the document to skew.

Operating the belt 52 in a stable condition on crowned pulleys or rollers 60, 70 without edge guides eliminates belt edge wear and possible detracking which may occur under unstable conditions. Accordingly, maintenance is minimized. The roller 60 may advantageously be rubber tyred to improve traction.

Ejection of documents from the platen 12 is initiated by the belt 52. However, the final push on to an output tray 110 is assisted by a pair of ejection rollers 74, 75 which are coaxial with the second roller 70. The pair of ejection rollers avoid skewing the document during ejection to provide a neat readily collectable output.

As will be understood from the foregoing, a document on the platen is ejected during a forward motion of the belt 52 which also serves to feed the next document onto the platen. Reversal of the belt drive is used to effect registration of this next document. If, however, as may sometimes happen, e.g., due to high humidity conditions, the previous document has not been fully ejected it will be fed back onto the platen during belt reversal and may interfere with the copying process. In order to avoid this happening, the eject rollers 74, 75 can only rotate in the eject direction. For this purpose the rollers 74, 75 are driven off the roller 70 through oneway drive mechanisms 150 such as sprags or "fibertrans" clutches. By preventing reverse rotation of the rollers 74, 75 the rollers act, during belt reversal, to prevent reverse movement of the document beneath them by reason of their frictional engagement with the document. For this purpose the rollers 74, 75 preferably have tyres 74*a*, 75*a* of rubber or other friction material. Further, the rollers 74, 75 are suitably of slightly greater diameter than the belt roller 70 plus the belt 52, so as to increase slightly the velocity of the document during ejection.

Documents being fed are urged against the rollers 74, 75 in a curved path by pairs of stationary curved guide fins 160. The fins are as shown arranged so that there is no direct contact between the fins and the rollers 74, 75 (or the belt 52). A coupling force is maintained by virtue of the beam strength imparted to the flexible, e.g., paper, document, which is curved in its direction of movement by the fins 160. The fins 160 also tend to corrugate in the paper in the lateral direction since the guide surfaces formed by the fins are arranged flush with or slightly radially inwardly of the peripheral surfaces of the associated rollers 74, 75. In one specific embodiment in which each roller 74, 75 is 2.5. inches in diameter, the guide surfaces of fins 160 are flush with the peripheries of the associated roller and the fins are spaced 0.15 inch laterally from the associated roller 74, 75.

In the embodiment illustrated, the fins 160 located between the belt 52 and the rollers may also act to guide the sheet against the belt passing over the roller 70.

With the arrangement described above the rollers 74, 75 and more particularly the belt 52 passing over roller 70 are not engaged by any friction means in the absence of a document and are, therefore, not subject to unnecessary wear.

Figure 3:
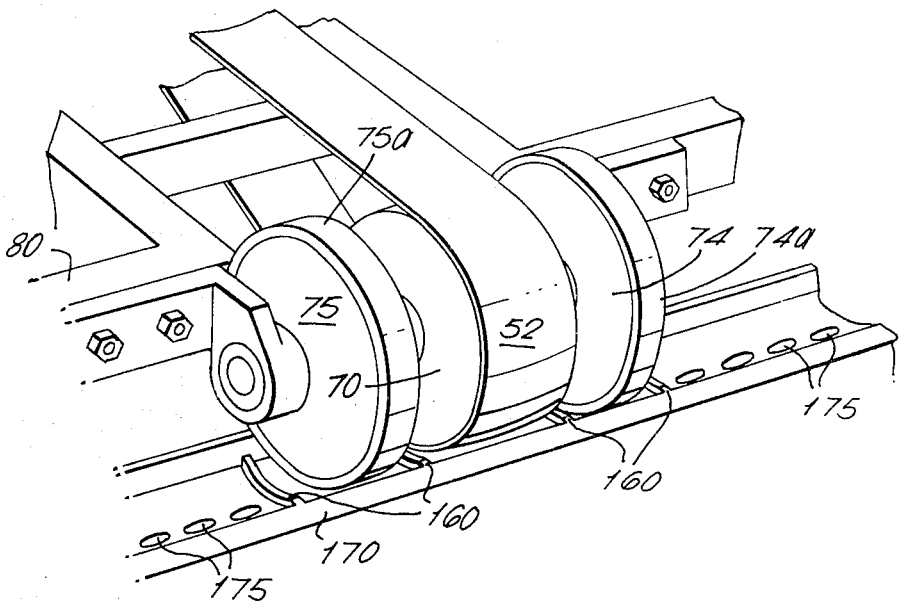
FIG. 3 is a perspective view of the document eject drive.
Figure 4:
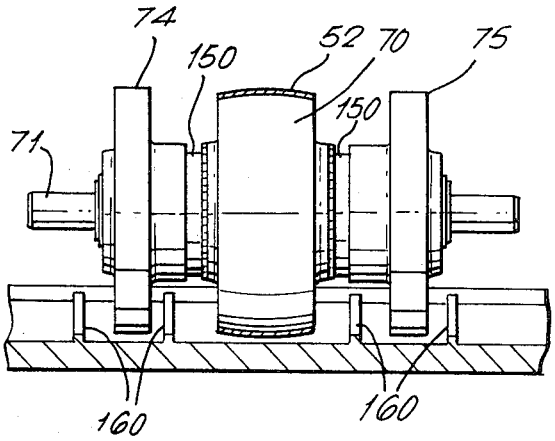
FIG. 4 is a schematic end view, partly in section, of the drive of FIG. 3.
Figure 5:
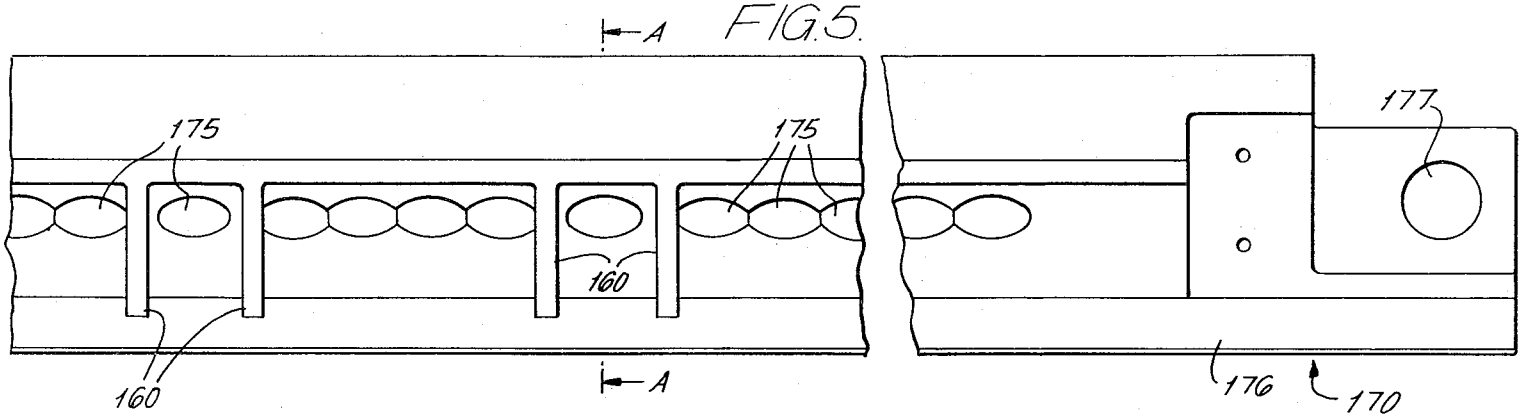
FIG. 5 is a top view of an anti-static bar provided at the eject edge of the platen.
Figure 6:
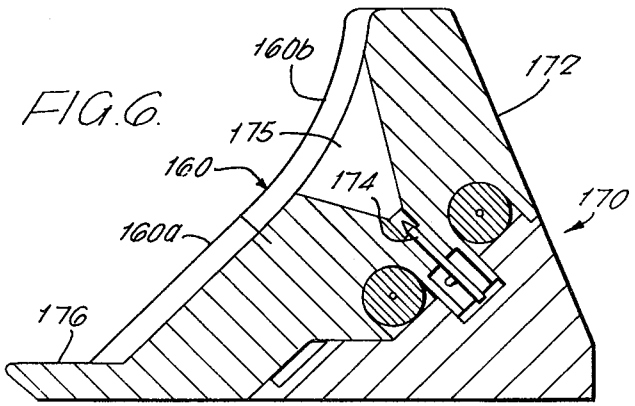
FIG. 6 is a section along the line A—A of FIG. 5.

In a preferred embodiment as illustrated in FIGS. 3, 5 and 6 in particular the fins 160 are formed integrally with the plastics body 172 of a corona discharge device 170. The device 170 is provided on the eject side of the platen 12 to neutralize any electrostatic charges in the documents which might impair subsequent handling of the documents. The device 170 is a so-called pin-type antistatic bar having a series of spaced pins 174 projecting through apertures 175 in the body moulding. The device is connected to a suitable source of high tension supply.

As seen in FIG. 6 the fins 160 do not faithfully follow the curvature of the rollers 74, 75 throughout their length but rather include a straight lead-in portion **160*a* generally at a tangent to the curved portion 160*b*. The body is also provided with a guide foot 176 and holes 177 for fixing screws. The body is formed of an insulating plastic material such as Noryl (trademark) and may comprise two separate mouldings as seen in FIG. 6**.

Power to drive the paper feeder 30 and the belt transport 50 is supplied by a motor 90 which may advantageously be located under the document tray 24. Rotary motion is transmitted from the motor drive gear 91 to a pair of counter rotating gears 92, 93 which in turn are each connected via clutches **92*a*, 93*a* to chain drive sprockets 92*b*, 93*b* respectively whereby alternate engagement of the clutches will transmit counter-clockwise or clockwise rotation respectively to a chain drive 94. A clutch surface between the gears 92, 93 and sprockets 92*b*, 93*b*, is engaged or disengaged by a clutch which is electrically energized in response to machine control logic. The chain drive 94 in turn causes the pinch rolls to drive intermittently and a series of interconnected gears generally indicated at 95 alternately to drive axis 61 and the first roller 60** in opposite first and second directions.

In operation, as the sheet feeder 30 begins to separate and feed a document 22, the platen baffle 200 is raised to open a document entrance gap below it and above the registration member 40 so that documents advanced by the pinch rolls 34 will enter the gap. When the pinch rolls 34 pass the forward or leading edge **22*a* of a document toward the nip 62 of the document transport 50 a sensing switch located between them is tripped which causes a trailing edge 22*b* of the document to be detected after which by a small delay the baffle 200 is caused to close against member 40 and the belt 52 is caused to reverse to the second direction. The reverse movement of the belt is timed to allow the trailing edge to abut the registration surface 42 and cause the belt 52** to slip over it briefly to assure full registration and correction of any skew.

Closure of the baffle 200 against the registration member 40 prevents movement of the trailing edge **22*b* over the registration edge 42 and minimizes the opportunity of the document 22** to buckle. In practice paper weights in a limited range of 47 to 120 grams per square meter have been very successfully handled giving rise to the belief that a much greater range may be accommodated.

Accurate registration of the document 22 on the exposure surface 12 is essential in that the relationship between a document to be copied, the mechanism by which it is to be copied and the material onto which it is to be copied are very precisely predetermined so that if registration is off the copy will not, in most cases of 1:1 copying onto document sized paper, include all of the original document. Even where document margins are such that essential information would not be lost as a result of misregistration nevertheless the aesthetics and integrity of copy would be severly reduced in the eyes of a reader.

After the document has been registered the predetermined number of copies are made and the logic control activates the document handler 20 to eject the copied document and forward the next document for registration and copying in similar fashion. This continues until a sensing switch (not shown) in the tray 24 detects the absence of documents and automatically stops the apparatus.

Although a preferred embodiment of the invention has been described it will be understood that various modifications may be made without departing from the scope of the claims. For example, two or more parallel narrow belts may be used in place of the single belt described.

While the preferred embodiment described has included a curved platen it will be understood that a flat platen or other processing station configuration may be used instead. Moreover, it will be understood that the terms - "platen" and exposure area" are intended to include any work station where a sheet of material is to be positioned so far as practical in a predetermined place. Thus, generally it matters not for what reason the sheet material is so positioned or the specific act performed upon it. For example, the "exposure" may include electronic scanning or magnetic read off.

I claim:

1. Sheet handling apparatus comprising a drive roller, means for rotating the roller, a pair of stationary curved guide surfaces for urging a sheet in a curved path against the periphery of the roller, the guide surfaces include straight lead in portions generally tangent to curved portions thereof while being spaced from the roller at opposite sides respectively thereof and arranged radially inwardly of the roller periphery such that the sheet is corrugated in the lateral direction in order to increase the beam strength of the sheet and thereby improve the coupling force between the sheet and the roller.

2. Apparatus according to claim 1 wherein the guide surfaces are formed by curved fins.

* * * * *